US011198955B2

(12) United States Patent
Seshayer et al.

(10) Patent No.: US 11,198,955 B2
(45) Date of Patent: Dec. 14, 2021

(54) DRAFTING SYSTEM UNIT AND DRAFTING SYSTEM FOR A SPINNING MACHINE

(71) Applicant: Saurer Intelligent Technology AG, Arbon (CH)

(72) Inventors: Chandrassekaran Seshayer, Herzogenrath (DE); Michael Korn, Stuttgart (DE); Philipp Schiffers, Erkelenz (DE); Ralf Siewert, Schwalmtal (DE); Heinz-Josef Peuker, Wegberg (DE); Karoline Guenther, Mönchengladbach (DE)

(73) Assignee: Saurer Intelligent Technology AG, Arbon (CH)

( * ) Notice: Subject to any disclaimer, the term of this patent is extended or adjusted under 35 U.S.C. 154(b) by 0 days.

(21) Appl. No.: 16/531,226

(22) Filed: Aug. 5, 2019

(65) Prior Publication Data

US 2020/0040486 A1 Feb. 6, 2020

(30) Foreign Application Priority Data

Aug. 3, 2018 (DE) ..... 10 2018 006 100.1

(51) Int. Cl.
*D01H 5/56* (2006.01)
*D01H 5/86* (2006.01)

(52) U.S. Cl.
CPC ..... *D01H 5/565* (2013.01); *D01H 5/86* (2013.01)

(58) Field of Classification Search
CPC ..... D01H 5/26; D01H 5/56; D01H 5/565; D01H 5/645; D01H 5/72; D01H 5/86
See application file for complete search history.

(56) References Cited

U.S. PATENT DOCUMENTS 2,659,936 A * 11/1953 Sandelin ..... D01H 5/72 19/248
6,134,872 A * 10/2000 Olbrich ..... D01H 5/26 57/264
6,170,126 B1 * 1/2001 Stahlecker ..... D01H 1/22 19/150
2001/0009052 A1 * 7/2001 Stahlecker ..... D01H 5/72 19/246

(Continued)

FOREIGN PATENT DOCUMENTS

EP 2 865 792 A1 4/2015

*Primary Examiner* — Shaun R Hurley
(74) *Attorney, Agent, or Firm* — Nelson Mullins Riley & Scarborough LLP

(57) ABSTRACT

A drafting system unit for a drafting system of a spinning machine having a first top roller and a second top roller spaced apart therefrom, characterized in that an apron cage to which negative pressure can be applied is arranged between the first top roller and the second top roller for guiding an air-permeable apron in circulation jointly around the apron cage and an apron top roller, the apron top roller being formed by the first top roller or by a third top roller that is assigned to the apron cage and arranged on the same side as the first and second top roller in relation to the fiber band being transported. The apron cage has at least one through-opening, to which negative pressure can be applied, for applying suction air to the fiber band running between the first and second top roller, through the air-permeable apron.

9 Claims, 4 Drawing Sheets

(56) References Cited

U.S. PATENT DOCUMENTS

| | | | | |
|---|---|---|---|---|
| 2001/0020357 | A1* | 9/2001 | Dinkelmann | D01H 5/26<br>57/315 |
| 2001/0029217 | A1* | 10/2001 | Stahlecker | D01H 1/22<br>474/266 |
| 2001/0049862 | A1* | 12/2001 | Camozzi | D01H 5/72<br>19/271 |
| 2017/0073851 | A1* | 3/2017 | Schneider | D01H 5/72 |

* cited by examiner

DRAFTING SYSTEM UNIT AND DRAFTING SYSTEM FOR A SPINNING MACHINE

CROSS-REFERENCE TO RELATED APPLICATIONS

This application claims priority from German National Patent Application No. 10 2018 006 100.1, filed Aug. 3, 2018, entitled "Streckwerkeinheit and Streckwerk für eine Spinnmaschine", the entire contents of which are incorporated herein by reference.

FIELD OF THE INVENTION

The invention relates to a drafting system unit for a drafting system of a spinning machine, in particular for an air spinning machine, the drafting system unit having, in a fiber band transport direction, a first top roller and a second top roller spaced apart therefrom, which are provided for drafting a fiber band, transported from the first to the second top roller, in cooperation with accordingly assigned bottom rollers, the respective axes of rotation of the first and second top roller extending transversely to the fiber band transport direction. The present invention also relates to a drafting system of this kind.

BACKGROUND OF THE INVENTION

Conventionally, in a spinning process, for example by means of a ring spinning machine or an air spinning machine having fixed production rates, a drafting system makes it possible to generate a fiber band that is drawn to a final fineness. Air spinning is a spinning process that has recently become established in addition to the known spinning processes, such as ring spinning, compression spinning and rotor spinning, and in which a yarn can be spun by the controlled use of an air flow in an air spinning unit. In spinning machines in general, the drafting system is arranged upstream of the spinning unit in the fiber transport direction, for example arranged upstream of the air spinning unit in the case of an air spinning machine. A drafting system of this kind is disclosed, for example in European Patent Publication EP 2 865 792 A1. In the case of an air spinning machine, at the drafting system end formed by an output roller pair, the drawn fiber band passes through a nozzle block of the downstream air spinning unit and arrives at an inlet opening of a hollow spinning spindle assigned to the air spinning unit. Upon entry into the spinning spindle, the free ends of the fiber band are looped around by a directed air flow circulating around a conical spindle head and in the process wind around the core fibers helically while the thread is being drawn into the spindle. Together with the "entwisting fibers" helically wound around the core fibers, the core fibers form the air-spun yarn.

Uniformity of the fiber band used to produce the yarn is essential for the quality of the yarn obtained in this manner. It is particularly important in this regard that the fibers of the fiber band are reliably arranged in parallel. The plurality of roller pairs typically arranged one behind the other in a drafting system, each consisting of a bottom roller and a top roller, are used to draft and transport the fiber band in the direction of the inlet opening of the hollow spinning spindle, the peripheral speed of the roller pairs increasing in the transport direction off the fiber band in order to obtain defined drawing. As shown schematically in FIG. 1 by way of example, in the nip region of the output roller pair, which is configured to transport the fiber band in the fiber band transport direction R by means of a top roller 4 rotatable in a direction of rotation OR and a bottom roller 5 rotatably in the opposite direction of rotation UR, the high rotational speeds of the output roller pair of the drafting system in particular generate air flows such as drag flows S and flows HS directed sideways out of the nip region. Flows S, HS of this kind may result in individual drafted fibers being deflected out of the fiber band or even being partly detached from the fiber band, thus having a negative impact on the fiber band quality and thus the yarn uniformity and the yarn quality in general. In the process, the effect of the air flows on the quality increases as the rotational speed of the output roller pair 4, 5 increases and thus as the air flows S, HS become more pronounced.

SUMMARY OF THE INVENTION

In particular, the present invention is intended to provide a drafting system unit for a drafting system of a spinning machine, for example an air spinning machine, by means of which it is possible to minimize deflection of fibers out of the fiber band due to an air flow caused by rotation of a roller pair.

To this end, the present invention proposes a drafting system unit having, in a fiber band transport direction, a first top roller and a second top roller spaced apart therefrom, which are provided for drafting a fiber band, transported from the first to the second top roller, in cooperation with accordingly assigned bottom rollers, the respective axes of rotation of the first and second top roller extending transversely to the fiber band transport direction.

The present invention is characterized in that an apron cage to which negative pressure can be applied is arranged between the first top roller and the second top roller for guiding an air-permeable apron in circulation jointly around the apron cage and an apron top roller. In the process, the apron top roller can be formed by the first top roller or by a third top roller that is assigned to the apron cage and arranged on the same side as the first and second top roller in relation to the fiber band being transported. The apron cage has at least one through-opening, to which negative pressure can be applied, for applying suction air to the fiber band running between the first and second top roller, through the air-permeable apron.

Advantageous developments of the invention are stated herein.

By means of the proposed invention, it can be ensured in a simple manner that the fibers that otherwise come out of the fiber band in the nip region due to drag flows and/or outward flows remain in the fiber band and can be entrained together with the fiber band in the fiber band transport direction. This can ensure a particularly high-quality fiber band, improved yarn uniformity and thus the possibility to produce a better-quality yarn.

According to a preferred embodiment, in the fiber band transport direction, the through-opening is at a smaller distance from the second top roller than from the apron top roller. The arrangement close to the second top roller favors the effect of fiber cohesion in the fiber band within the nip region of the downstream roller pair.

In a further preferred configuration, the through-opening can be arranged close to or within an nip region between the top roller and the fiber band in order to directly counteract the drag flows and outward flows by means of a counterforce exerted by the application of suction air. This preferred embodiment is also advantageous for the fiber cohesion in the fiber band within the nip region.

Preferably, the through-opening is formed at an opposite end of the apron cage to the second top roller. This enables an arrangement extremely close to the second top roller.

In a further preferred embodiment, the through-opening is formed as a slot extending transversely to the fiber band transport direction. The fiber band region to which suction air can be applied can be enlarged in a direction running transversely to the fiber band transport direction, in which case even better fiber cohesion in the fiber band within the nip region can be achieved.

According to a further preferred embodiment, the apron cage can have more than one through-opening. For instance, the respective dimensions of the through-openings and their arrangement facing the fiber band can be selected and provided as required in order to ensure further improvement to the fiber cohesion in the fiber band within the nip region.

Preferably, the through-opening is arranged so as to face the fiber band between the opposite side edges thereof. As a result, a suction flow directed towards the center of the fiber band can act on the fiber band through the air-permeable apron, in which case the fiber cohesion, in particular of the edge fibers, in the fiber band within the nip region can be further improved.

The through-opening can be coupled to the apron cage either directly or indirectly. Direct coupling is provided when the through-opening is formed for example in the apron cage. Indirect coupling occurs when the through-opening is formed by a means that can be attached to the apron cage and to which negative pressure can be applied either by means of the apron cage or directly.

According to a further preferred embodiment, the second top roller forms an output top roller for the drafting system comprising the drafting system unit. The apron cage to which negative pressure can be applied is consequently arranged in a main drawing field of the drafting system. As a result, the fiber cohesion in the fiber band can be reliably ensured directly upstream of the exit of the fiber band from the drafting system and upstream of the transition, for example, into a spinning unit arranged downstream in the fiber transport direction.

Alternatively or additionally, it is conceivable that the apron cage, to which negative pressure can be applied, is arranged in a pre-drawing field upstream of the main drawing field in the fiber band transport direction in order to ensure, as early as at this point, the fiber cohesion in the fiber band within the nip region of a roller pair arranged upstream of the output roller pair in the fiber band transport direction. The preferred alternative arrangement already favors improvement to the quality of the fiber band compared with a previously known drafting system. The additional arrangement is also advantageous in that fiber cohesion in the fiber band within the nip region of each roller pair associated with the drafting system is ensured over approximately the entire length of the drafting system in the fiber band transport direction.

According to a further aspect of the present invention, a drafting system for a spinning machine, in particular an air spinning machine, is provided, having a first roller pair comprising a first top roller and a first bottom roller, and a second roller pair formed by a second top roller and a second bottom roller. The first and second roller pair are spaced apart from one another in the fiber band transport direction and are provided for drafting a fiber band transported from the first to the second roller pair. The respective axes of rotation of the first and second roller pair, i.e. the axes of rotation of the assigned bottom and top rollers, extend transversely to the fiber band transport direction.

The drafting system is characterized in that an apron cage to which negative pressure can be applied is arranged between the first roller pair and the second roller pair for guiding an air-permeable apron in circulation jointly around the apron cage and an apron top roller, the apron top roller being formed by the first top roller of the first roller pair arranged upstream, i.e. earlier, in the fiber band transport direction, or by a third top roller that is assigned to the apron cage and arranged on the same side as the first and second top roller in relation to the fiber band being transported, between said top rollers. The apron cage has at least one through-opening, to which negative pressure can be applied, for applying suction air to the fiber band running between the first roller pair and the second roller pair, through the air-permeable apron.

According to a preferred embodiment, the apron top roller, the first and second top roller, and the apron cage form a drafting system unit according to any of the embodiments described above.

By means of a drafting system of this kind, the same advantages as described above can be achieved.

According to a further aspect of the present invention, it is proposed to use a fiber band compression device, which is provided in a draft ng system for compressing a drafted fiber band passing through an output top roller of a drafting system, the fiber band compression device having an apron cage, to which negative pressure can be applied, for guiding an air-permeable apron in circulation jointly around an apron top roller and the apron cage, which has at least one through-opening to which negative pressure can be applied.

The use is characterized in that the fiber band compression device is arranged between a first roller pair and a second roller pair of the drafting system such that the apron cage guides the air-permeable apron jointly around the apron top roller and the apron cage, the apron top roller being formed by the first top roller of the first roller pair arranged upstream in the fiber transport direction, or by a third top roller that is assigned to the apron cage and arranged on the same side as the top rollers of the first and second roller pair in relation to the fiber band being transported. The through-opening is arranged so as to apply suction air to a fiber band running between the two spaced-apart roller pairs, through the air-permeable apron.

According to a preferred embodiment, the apron top roller, the first and second top roller, and the apron cage form a drafting system unit according to any of the embodiments described above.

By means of such a use of a fiber band compression device, the same advantages as described above can be achieved.

The preferred embodiments described above are particularly advantageous for an air spinning machine. However, the preferred embodiments described above can also be used in other spinning machine types, such as ring spinning machines, roving frames, compact spinning machines, Siro spinning machines and the like.

It should be understood that the detailed description and specific examples, while indicating the preferred embodiments of the invention, are intended for purposes of illustration only and are not intended to limit the scope of the invention.

BRIEF DESCRIPTION OF THE DRAWINGS

The invention will be explained in greater detail below on the basis of embodiment examples shown in the drawings.

In the following description of embodiment examples, the same or similar reference signs are used for the elements shown in the various figures and those having a similar action, in which case the descriptions of these elements are not repeated.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 2:
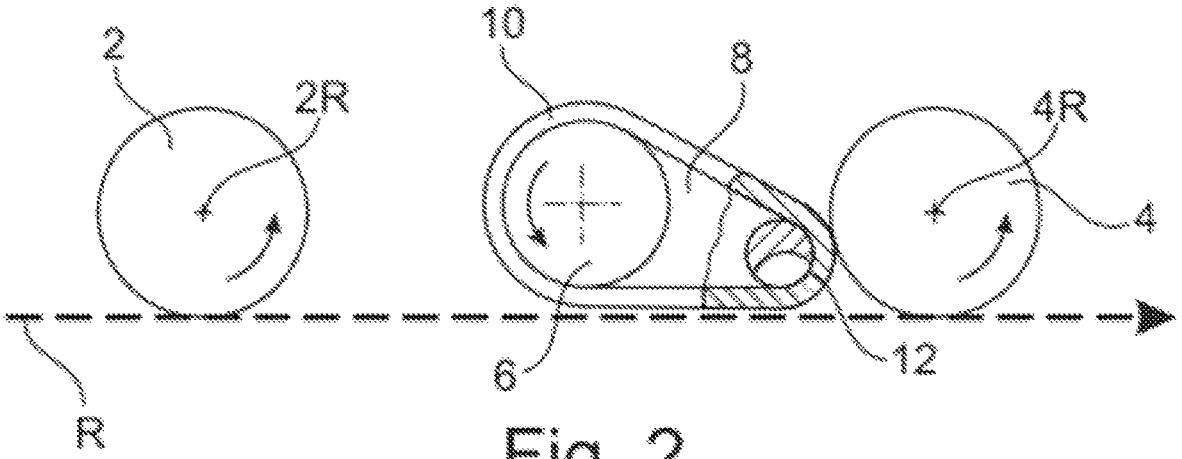
FIG. 2 shows a schematic view of a drafting system unit according to a first embodiment example.
Figure 3:
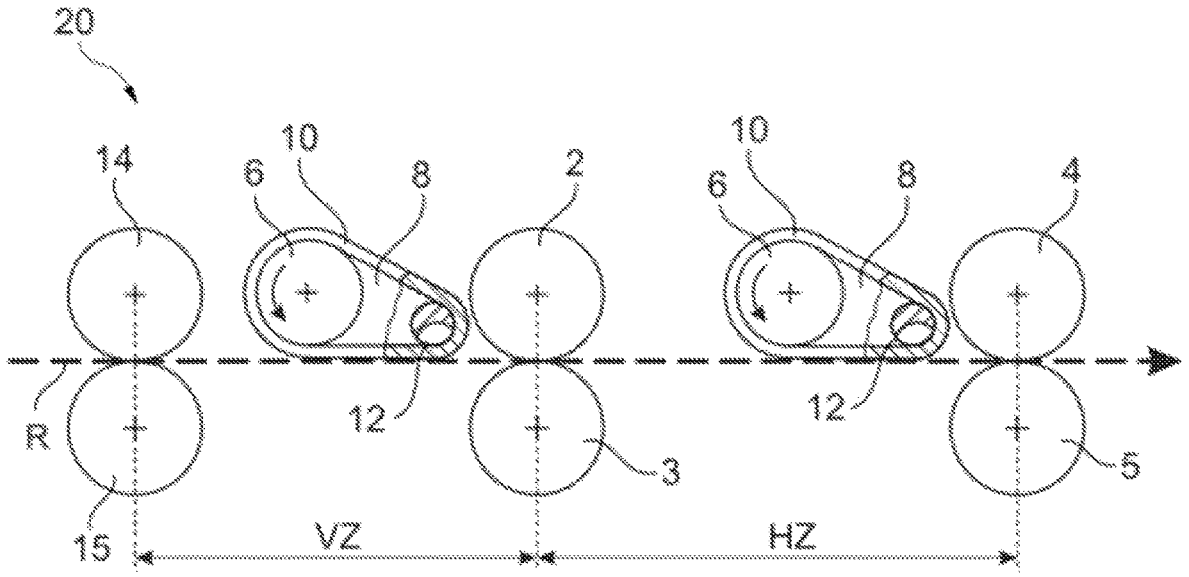
FIG. 3 shows a schematic view of a drafting system comprising a drafting system unit shown in FIG. 1.

FIG. 2 is a schematic side view of a drafting system unit 1 according to one embodiment example. In a fiber band transport direction R, the drafting system unit 1 has a first top roller 2 and a second top roller 4 spaced apart therefrom. The first 2 and second 4 top roller are provided for drafting a fiber band transported from the first to the second top roller in the fiber band transport direction R, in cooperation with accordingly assigned bottom rollers 3, 5 (FIG. 3). The respective axes of rotation 2R, 4R of the two top rollers 2, 4 extend transversely to the fiber band transport direction R. Configuring and arranging such "drafting system top rollers" is routine and would be familiar to one of ordinary skill in the art.

Figure 4:
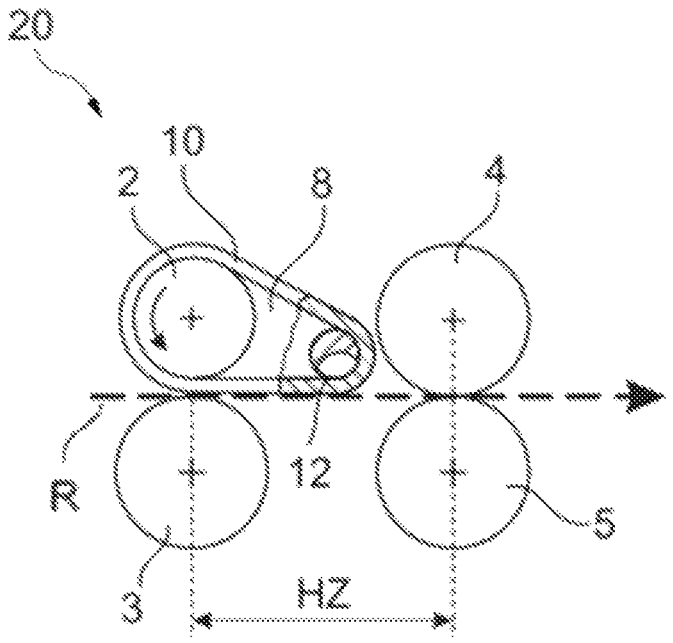

Between the first top roller 2 and the second top roller 4, an apron cage 8, to which negative pressure can be applied, is arranged for guiding an air-permeable apron 10 in circulation jointly around the apron cage 8 and an apron top roller 6, which is formed by a third top roller 6 that is assigned to the apron cage 8 and arranged in the apron cage 8 according to this embodiment example. In relation to the fiber band being transported in the fiber band transport direction, the apron top roller 6 is arranged on the same side as the first 2 and second 4 top roller. Alternatively, according to one embodiment example and as shown in FIG. 4, the apron top roller can be formed by the first top roller 2, in which case the air-permeable apron 10 thus runs around the first top roller 2.

The apron cage 8 has at least one through-opening 12, to which negative pressure can be applied, for applying suction air to the fiber band running between the first 2 and second 4 top roller, through the air-permeable apron 10. The through-opening 12 is arranged on the apron cage 8 facing the fiber band, and is connected to a negative pressure source (not shown) either indirectly by means of the apron cage 8 or directly. For this purpose, the through-opening 12 can be coupled to negative pressure conduit formed together with the apron cage 8, or to an external negative pressure conduit leading to the through-opening 12. The through-opening 12 can have a shape selected as required for applying the suction air to the fiber band by means of the air-permeable apron 10.

Figure 1:
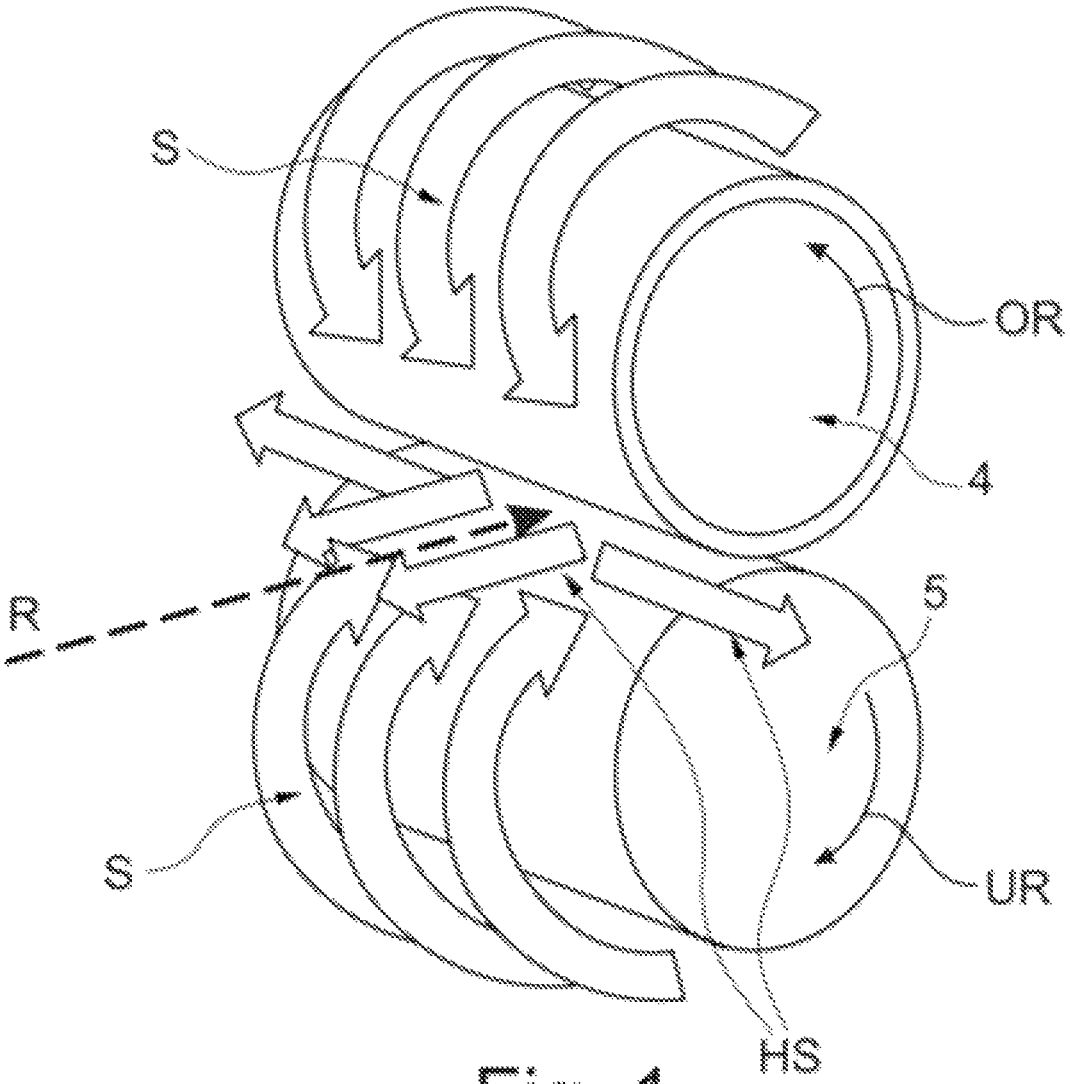
FIG. 1 shows a schematic view of air flows occurring in a rotating roller pair according to the prior art.

FIG. 3 is a schematic view of a drafting system 20 comprising a drafting system unit 1 shown in FIG. 1, in each case in a fiber drawing region or fiber drafting region VZ, HZ.

The drafting system 20 has a first roller pair 2, 3, which is formed by the first top roller 2 and a first bottom roller 3 interacting therewith. The first top roller 2 and the first bottom roller 3 are arranged such that a clamping line is formed in between them for clamping the fiber band being guided between the first top roller 2 and the first bottom roller 3. During drafting system 20 operation, the first roller pair 2, 3 rotates at a defined first rotational speed in such a manner as to transport the fiber band in the fiber band transport direction R.

In addition, a second roller pair 4, 5 is provided, which is formed by the second top roller 4 and a second bottom roller 5 interacting therewith, in a manner equivalent to the first roller pair 2, 3. During drafting system 20 operation, the second roller pair 4, 5 rotates at a higher speed than the first roller pair 2, 3. In this embodiment example, the second roller pair 4, 5 forms the output roller pair of the drafting system 20. Due to the different rotational speeds between the first 2, 3 and second 4, 5 roller pairs, the fiber band being transported in a clamped manner from the first roller pair 2, 3 to the second roller pair 4, 5 is drawn. In this embodiment example, the region formed between the clamping lines of the first 2, 3 and second 4, 5 roller pairs forms a "main drawing field" HZ. The first 2, 3 and second 4, 5 roller pairs can be driven in the normal manner, for example by means of a single drive of the associated top or bottom roller or by means of a common drive driving a plurality of bottom rollers or one joint bottom roller of drafting systems arranged in the machine longitudinal direction.

The drafting system 20 further has a third roller pair 14, 15, which is formed, in an equivalent manner to the first 2, 3 and second 4, 5 roller pairs, by a fourth top roller 14 and a fourth bottom roller 15 interacting therewith. In this embodiment example, the third roller pair 14, 15 forms the input roller pair for the drafting system 20, the fiber band being introduced into the drafting system 20 by means of said input roller pair. During drafting system 20 operation, the third roller pair 14, 15 rotates at a lower speed than the first, roller pair 2, 3. As a result, an additional drafting region, a "pre-drawing field", is formed between the first roller pair 2, 3 and the input roller pair 14, 15, the fiber band undergoing initial drafting to a lesser extent in said pre-drawing field than in the main drawing field.

According to this embodiment example, an apron cage 8 having an apron top roller 6 and an air-permeable apron 10 circulating jointly around the apron cage 8 and the apron top roller 6 is arranged in each case in both the pre-drawing field VZ and the main drawing field HZ. The apron cage 8 is connected to a negative pressure source (not shown) and has a negative pressure conduit leading to a through-opening 12. In each apron cage 8, the through-opening 12 is provided facing the fiber band being transported, close to the first 2, 3 or second 4, 5 roller pair arranged downstream in the fiber band direction R, so as to apply suction air to the fiber band through the air-permeable apron 10. Advantageously, the through-opening 12 can be formed at the opposite edge of the apron cage 8 to the downstream first 2, 3 or second 4, 5 roller pair so as to ensure the suction air is applied to the fiber band through the air-permeable apron 10 either as close as possible to or in the nip region of the corresponding downstream first 2, 3 or second 4, 5 roller pair.

The described embodiment examples shown in the figures are only selected by way of example. Different embodiment examples can be combined with one another completely or with regard to individual features. Also, an embodiment example can be supplemented by features of a further embodiment example.

If an embodiment example has an "and/or" link between a first feature and a second feature, this should be understood to mean that the embodiment example according to one embodiment comprises both the first feature and the second feature and, according to a further embodiment, comprises either only the first feature or only the second feature.

LIST OF REFERENCE SIGNS

1 Drafting system unit
2 First top roller
2R Axis of rotation of the first top roller
3 First bottom roller
4 Second top roller
4R Axis of rotation of the second top roller
5 Second bottom roller
6 Third top roller
7 Third bottom roller
8 Apron cage
10 Air-permeable apron
12 Through-opening
20 Drafting system
HS Outward flow
OR Top roller direction of rotation
R Fiber band transport direction
S Drag flow
UR Bottom roller direction of rotation
VS Pre-drawing field
HZ Main drawing field It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A drafting system unit for a drafting system of a spinning machine, the drafting system unit having, in a fiber band transport direction (R), a first top roller and a second top roller spaced apart therefrom, which are provided for drafting a fiber band, transported from the first to the second top roller, in cooperation with accordingly assigned bottom rollers, the respective axes of rotation of the first and second top roller extending transversely to the fiber band transport direction (R), characterized in that an apron cage to which negative pressure can be applied is arranged between the first top roller and the second top roller for guiding an air-permeable apron in circulation jointly around the apron cage and an apron top roller, the apron top roller being formed by the first top roller or by a third top roller that is assigned to the apron cage and arranged on the same side as the first and second top roller in relation to the fiber band being transported, and the apron cage having at least one through-opening, to which negative pressure can be applied, for applying suction air to the fiber band running between the first and second top roller, through the air-permeable apron, wherein in the fiber band transport direction (R), the at least one through-opening is at a smaller distance from the second top roller than from the apron top roller.

2. The drafting system unit according to claim 1, characterized in that the at least one through-opening is formed at an end of the apron cage that is adjacent to the second top roller.

3. The drafting system unit according to claim 1, characterized in that the at least one through-opening is formed as a slot extending transversely to the fiber band transport direction (R).

4. The drafting system unit according claim 1, characterized in that the at least one through-opening is arranged so as to face the fiber band between the side edges of the fiber band.

5. The drafting system unit according to claim 1, characterized in that the second top roller is configured to form an output top roller for the drafting system comprising the drafting system unit.

6. A drafting system for a spinning machine, having a first roller pair, which comprises a first top roller and a first bottom roller, and a second roller pair, which is formed by a second top roller and a second bottom roller, the first and second roller pair being spaced apart from one another in a fiber band transport direction (R) and being provided for drafting a fiber band transported from the first to the second roller pair, the respective axes of rotation of the first and second roller pair extending transversely to the fiber band transport direction (R), characterized in that an apron cage to which negative pressure can be applied is arranged between the first roller pair and the second roller pair for guiding an air-permeable apron in circulation jointly around the apron cage and an apron top roller, the apron top roller being formed by the first top roller of the first roller pair arranged upstream in the fiber band transport direction, or by a third top roller that is assigned to the apron cage and arranged on the same side as the first and second top roller in relation to the fiber band being transported, and the apron cage having at least one through-opening, to which negative pressure can be applied, for applying suction air to the fiber band running between the first roller pair and the second roller pair, through the air-permeable apron.

7. The drafting system according to claim 6, characterized in that the apron top roller, the first and second top roller, and the apron cage form a drafting system unit having, in the fiber band transport direction (R), the first top roller and the second top roller spaced apart therefrom, which are provided for drafting the fiber band, transported from the first top roller to the second top roller, in cooperation with accordingly assigned bottom rollers, the respective axes of rotation of the first and second top roller extending transversely to the fiber band transport direction (R), wherein the apron cage to which negative pressure can be applied is arranged between the first top roller and the second top roller for guiding the air-permeable apron in circulation jointly around the apron cage and the apron top roller, the apron top roller being formed by the first top roller or by the third top roller that is assigned to the apron cage and arranged on the same side as the first and second top roller in relation to the fiber band being transported, and the apron cage having the at least one through-opening, to which negative pressure can be applied, for applying suction air to the fiber band running between the first and second top roller, through the air-permeable apron.

8. A method of using a fiber band compression device for compressing, within a drafting system, a fiber band passing through an output top roller of a drafting system, the fiber band compression device having an apron cage, to which negative pressure can be applied, for guiding an air-permeable apron in circulation around an apron top roller and the apron cage, which has at least one through-opening to which negative pressure can be applied, characterised in that the fiber band compression device is arranged between a first roller pair and a second roller pair of the drafting system such that the apron cage guides the air-permeable apron jointly around the apron top roller and the apron cage, the apron top roller being formed by the first top roller of the first roller pair arranged upstream in the fiber transport direction, or by a third top roller that is assigned to the apron cage and arranged on the same side as the top rollers of the first and second roller pair in relation to the fiber band being transported, and the at least one through-opening is arranged to apply suction air to the fiber band running between the spaced-apart roller pairs, through the air-permeable apron.

9. The method of using a fiber band compression device according to claim 8, characterized in that the apron top roller, the first and second top roller, and the apron cage form a drafting system unit of a spinning machine, the drafting system unit having, in a fiber band transport direction (R), a first top roller and a second top roller spaced apart therefrom, which are provided for drafting the fiber band, transported from the first to the second top roller, in cooperation with accordingly assigned bottom rollers, the respective axes of rotation of the first and second top roller extending transversely to the fiber band transport direction (R), characterized in that the apron cage to which negative pressure can be applied is arranged between the first top roller and the second top roller for guiding the air-permeable apron in circulation jointly around the apron cage and the apron top roller, the apron top roller being formed by the first top roller or by the third top roller that is assigned to the apron cage and arranged on the same side as the first and second top roller in relation to the fiber band being transported, and the apron cage having the at least one through-opening, to which negative pressure can be applied, for applying suction air to the fiber band running between the first and second top roller, through the air-permeable apron.

* * * * *